US005916348A

United States Patent [19]

Lanfredi

[11] Patent Number: 5,916,348

[45] Date of Patent: Jun. 29, 1999

[54] WOBBLE-PLATE PUMP INCLUDING A MUSHROOM-SHAPED INCLINED WOBBLE-PLATE

[75] Inventor: Giancarlo Lanfredi, Suzzara, Italy

[73] Assignee: Lavorwash S.r.l., Suzzara, Italy

[21] Appl. No.: 08/885,961

[22] Filed: Jun. 30, 1997

[30] Foreign Application Priority Data

Jul. 3, 1996 [IT] Italy ..... PD96A0171

[51] Int. Cl.[6] ..... F01B 3/00

[52] U.S. Cl. ..... 92/71; 92/129; 74/60

[58] Field of Search ..... 92/12.2, 71, 57, 92/129; 91/499, 504, 505, 506; 417/269; 74/60

[56] References Cited

U.S. PATENT DOCUMENTS

| | | | |
|---|---|---|---|
| 4,546,692 | 10/1985 | Lotter et al. | 92/12.2 |
| 4,565,117 | 1/1986 | Forster | 92/57 |
| 4,788,902 | 12/1988 | Akasaka et al. | 91/504 |
| 5,275,087 | 1/1994 | Akuzawa et al. | 417/269 |
| 5,354,181 | 10/1994 | Porel | 417/269 |
| 5,700,135 | 12/1997 | Inokuchi et al. | 417/269 |

*Primary Examiner*—Thomas E. Denion
*Attorney, Agent, or Firm*—Guido Modiano; Albert Josif

[57] ABSTRACT

A wobble-plate pump including a mushroom-shaped inclined wobble plate which is keyed directly on supporting bearings and is suitable to alternately move axial pistons. The mushroom-shaped wobble plate is connected to a drive shaft by connection elements.

6 Claims, 2 Drawing Sheets

WOBBLE-PLATE PUMP INCLUDING A MUSHROOM-SHAPED INCLINED WOBBLE-PLATE

BACKGROUND OF THE INVENTION

The present invention relates to a wobble-plate pump.

It is known that wobble-plate pumps have been used and appreciated for a long time in many fields; although they have different scopes of application, said pumps all have a substantially common structure.

In particular, a wobble-plate pump comprises an inclined wobble plate which is fixed, by means of a screw (in other cases it can be fixed by interference fit) or of another threaded element, to a connecting shaft fitted on a bearing which is rigidly coupled to a dome which is intermediate between the pump body and the motor body.

The wobble plate is suitable to alternately move pistons in an axial direction.

The wobble-plate pump, despite having been tested and used for a long time, is not free from drawbacks; a particularly important drawback is the difficulty in achieving a good alignment between the connecting shaft and the bearing.

Good alignment between these two elements in fact requires precision machining for the connections to the drive shaft and to the wobble plate.

Moreover, the interposition of a connecting shaft complicates the overall structure of the pump, increasing the number of its components and therefore its production costs.

SUMMARY OF THE INVENTION

The aim of the present invention is to provide a wobble-plate pump having a simple structure and a limited number of components.

Within the scope of this aim, an object of the invention is to provide a wobble-plate pump having no connecting shafts between the wobble plate and the drive shaft.

Another object of the present invention is to provide a wobble-plate pump which can be manufactured at competitive costs with respect to currently commercially available pumps.

Another object of the present invention is to provide a wobble-plate pump which has a particularly solid and strong structure and furthermore requires limited maintenance.

Another object of the present invention is to provide a wobble-plate pump which can be manufactured with conventional technologies and in models which are suitable for the most disparate application requirements.

This aim, these objects, and others which will become apparent hereinafter are achieved by a wobble-plate pump, characterized in that it comprises a mushroom-shaped inclined wobble plate which is keyed directly on supporting bearings and is suitable to alternately move axial pistons, said mushroom-shaped wobble plate being connected to a drive shaft by connection means.

BRIEF DESCRIPTION OF THE DRAWINGS

Further characteristics and advantages of the present invention will become apparent from the following detailed description of an embodiment thereof, illustrated only by way of non-limitative example in the accompanying drawings, wherein.

DESCRIPTION OF THE PREFERRED EMBODIMENTS

Figure 1:
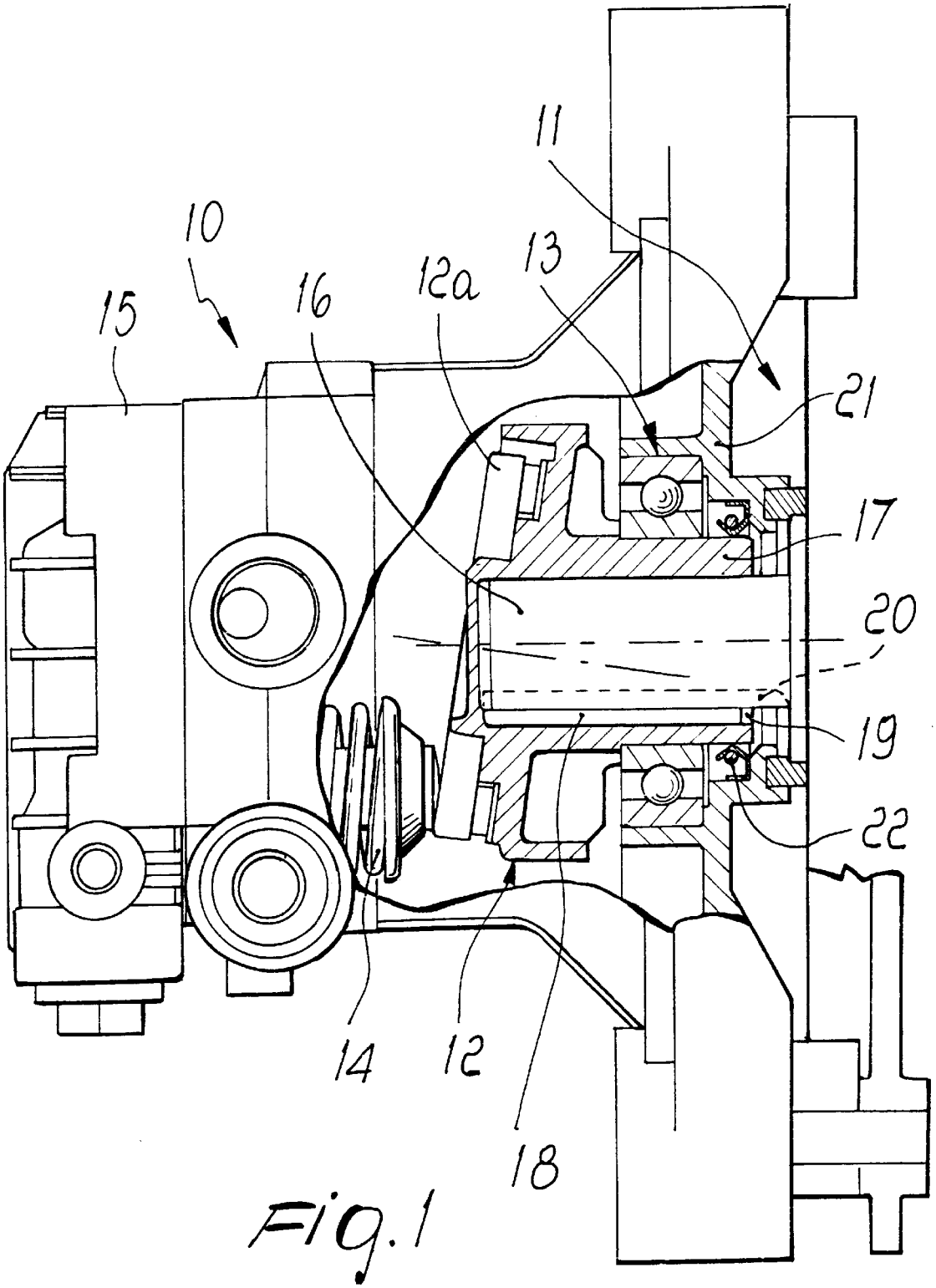
FIG. 1 is a partially sectional view of a wobble-plate pump according to the invention, associated with a drive unit which is shown partially.
Figure 2:
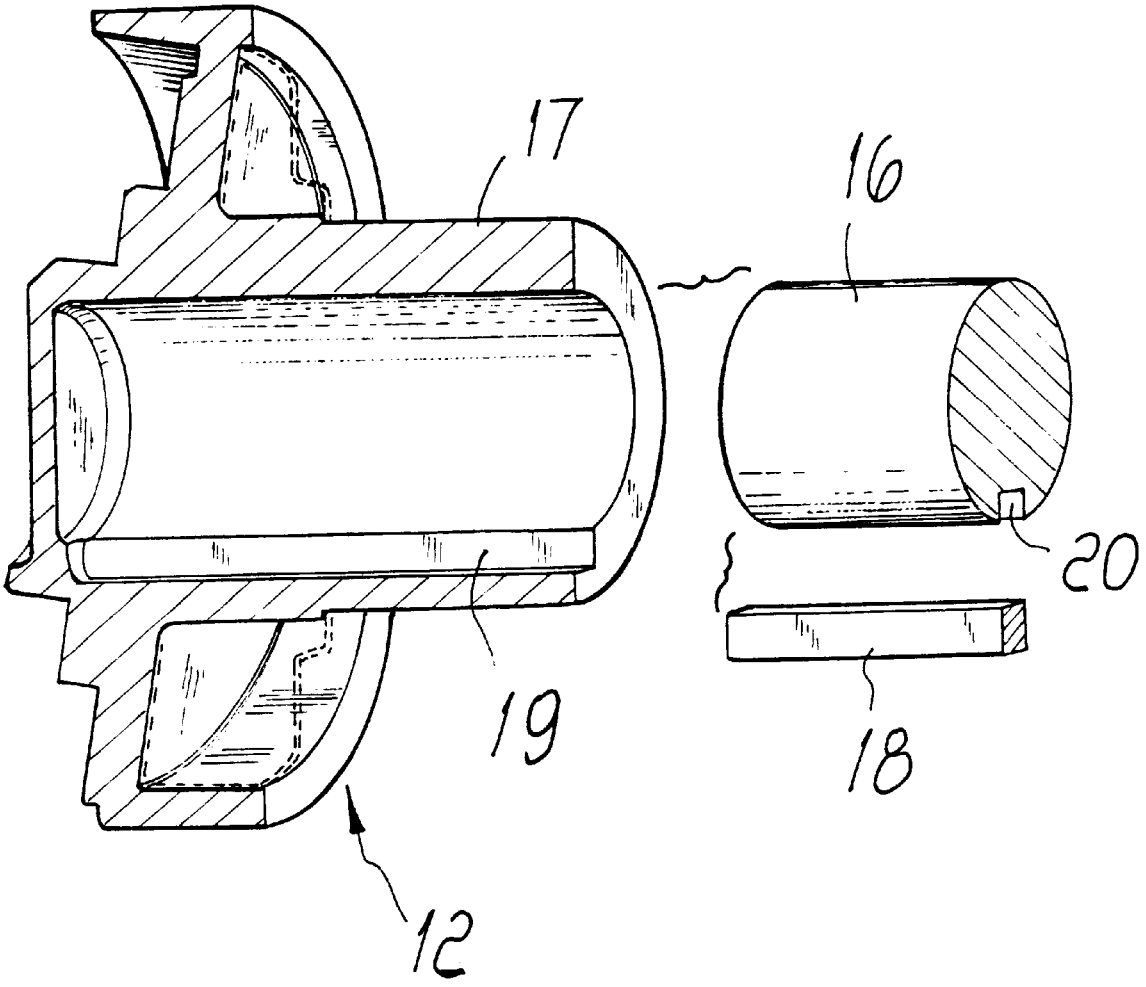
FIG. 2 is a sectional exploded view of a detail of the pump of FIG. 1.

With particular reference to FIGS. 1 and 2, a wobble-plate pump according to the invention is generally designated by the reference numeral 10.

The wobble-plate pump 10 is connected, in this case, to a drive unit which is generally designated by the reference numeral 11 and is shown partially in FIG. 1.

The pump 10 comprises a mushroom-shaped wobble plate 12 which is keyed directly on supporting bearings, generally designated by the reference numeral 13, and is suitable to move axially, by forming an inclined plane 12*a,* axial pistons which are designated by the reference numeral 14 and are contained within the body 15 of the pump 10.

In this case, the bearings 13 are constituted by a rolling bearing which is more specifically of the ball type.

The wobble plate 12 is also connected, by connecting means described hereafter, to a drive shaft 16 of a drive unit 11.

More specifically, a tubular tang 17 protrudes axially from the wobble plate 12 and is directed away from the pistons 14 upon assembly; the head of the shaft 16 fits in said tang.

The connection between the wobble plate 12 and the shaft 16 occurs, in this embodiment, by means of a key 18 which enters slots 19 and 20 formed respectively at the inner surface of the tang 17 and at the outer surface of the shaft 16.

The bearing 13, in this case, is perimetrically supported by a flanged element 21 which is associated with the drive unit 11 by means of threaded elements, not shown.

The pump 10, in its connection to the drive unit 11, is also provided with sealing means which in this case are constituted by annular gaskets 22.

In practice, it has been observed that the present invention has achieved the intended aim and objects.

In particular, the constructive simplicity of the present invention should be noted; it absolutely does not require the provision of a connecting shaft, consequently eliminating the alignment problems and drastically reducing precision machining.

The reduction in precision machining accordingly entails a decrease in production costs, which are further reduced by the low number of components of the pump according to the invention.

It should also be noted that said pump according to the invention has a particularly solid structure which is suitable even for long and intensive duty cycles.

It should also be noted that the structure of the pump according to the invention is flexible and can be adapted to the most disparate application requirements.

The present invention is susceptible of numerous modifications and variations, all of which are within the scope of the inventive concept; the details may also be replaced with other technically equivalent elements.

What is claimed is:

1. A wobble-plate pump, comprising:

a pump body;

a mushroom-shaped inclined wobble plate rotatable about a rotation axis, said mushroom-shaped inclined wobble plate comprising an inclined plane surface extending in a plane which is inclined with respect to said rotation axis, and a tubular tang extending from said inclined plane surface and having a hollow tubular portion having a longitudinal axis which coincides with said rotation axis;

axial pistons arranged in said pump body and operatively connected with said inclined plane surface such that a rotation of said mushroom-shaped inclined wobble plate causes said axial pistons to move reciprocatingly in axial directions extending parallel to said rotation axis;

a drive unit connected to said pump body, said drive unit comprising a drive shaft which is arranged inside said hollow tubular portion of said tubular tang so as to be connected to said mushroom-shaped inclined wobble plate for rotating said mushroom-shaped inclined wobble plate; and supporting bearings arranged directly between said tubular tang and a supporting element of said drive unit.

2. A pump according to claim 1, wherein said tubular tang lies opposite to said axial pistons with respect to said inclined plane surface.

3. A pump according to claim 2, wherein said drive shaft is connected to said tubular tang by means of a key which is inserted in respective slots formed at an inner surface of said tubular tang and at an outer surface of said drive shaft, said slots extending parallel to sad rotation axis.

4. A pump according to claim 1, wherein said supporting bearings are of the rolling type.

5. A pump according to claim 1, wherein said supporting element of said drive unit is constituted by a flanged element.

6. A pump according to claim 1, further comprising sealing means arranged between said tubular tang and the drive unit.

* * * * *